US006964835B2

(12) United States Patent
Hasegawa et al.

(10) Patent No.: US 6,964,835 B2
(45) Date of Patent: Nov. 15, 2005

(54) TONER AND IMAGE FORMING METHOD USING THE TONER

(75) Inventors: Kumi Hasegawa, Numazu (JP); Mitsuo Aoki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 177 days.

(21) Appl. No.: 10/622,768

(22) Filed: Jul. 21, 2003

(65) Prior Publication Data

US 2005/0175924 A1 Aug. 11, 2005

(30) Foreign Application Priority Data

Jul. 19, 2002 (JP) ..... 2002-211125
Sep. 19, 2002 (JP) ..... 2002-272809

(51) Int. Cl.[7] ..... G03G 9/08
(52) U.S. Cl. ..... 430/108.3; 430/109.4; 430/111.41; 430/124; 430/125
(58) Field of Search ..... 430/108.3, 108.4, 430/124, 125, 111.41, 109.4

(56) References Cited

U.S. PATENT DOCUMENTS

| | | | | |
|---|---|---|---|---|
| 5,482,807 | A | 1/1996 | Aoki et al. | |
| 5,519,316 | A | 5/1996 | Hagiwara et al. | |
| 5,614,347 | A | 3/1997 | Aoki et al. | |
| 5,747,210 | A | 5/1998 | Emoto et al. | |
| 5,912,100 | A | 6/1999 | Aoki et al. | |
| 5,994,016 | A | 11/1999 | Kuramoto et al. | |
| 6,004,715 | A | 12/1999 | Suzuki et al. | |
| 6,060,201 | A | 5/2000 | Kinoshita et al. | |
| 6,120,960 | A | 9/2000 | Aoki et al. | |
| 6,168,894 | B1 | 1/2001 | Aoki et al. | |
| 6,183,927 | B1 * | 2/2001 | Magome et al. | 430/108.3 |
| 6,221,549 | B1 | 4/2001 | Emoto et al. | |
| 6,248,488 | B1 | 6/2001 | Kinoshita et al. | |
| 6,255,028 | B1 | 7/2001 | Hasegawa et al. | |
| 6,303,257 | B1 | 10/2001 | Hasegawa et al. | |
| 6,403,275 | B1 | 6/2002 | Kuramoto et al. | |
| 6,432,590 | B1 | 8/2002 | Ueda et al. | |
| 6,468,706 | B2 | 10/2002 | Matsuda et al. | |
| 6,544,704 | B1 | 4/2003 | Matsuda et al. | |
| 2002/0001765 | A1 | 1/2002 | Higuchi et al. | |

FOREIGN PATENT DOCUMENTS

| | | |
|---|---|---|
| EP | 0 957 406 | 11/1999 |
| EP | 1 096 325 | 5/2001 |
| JP | 53-127726 | 11/1978 |
| JP | 57-111541 | 7/1982 |
| JP | 61-069073 | 4/1986 |
| JP | 61-221756 | 10/1986 |
| JP | 63-058356 | 3/1988 |
| JP | 02-162355 | 6/1990 |
| JP | 03-002874 | 1/1991 |
| JP | 03-122661 | 5/1991 |
| JP | 03-155563 | 7/1991 |
| JP | 09-022149 | 1/1997 |
| JP | 09-124659 | 5/1997 |
| JP | 09-166891 | 6/1997 |
| JP | 10-246989 | 9/1998 |
| JP | 2000-147828 | 5/2000 |
| JP | 2001-066830 | 3/2001 |

* cited by examiner

*Primary Examiner*—Christopher Rodee
(74) *Attorney, Agent, or Firm*—Oblon, Spivak, McClelland, Maier & Neustadt, P.C.

(57) ABSTRACT

A toner including a at least a binder resin; a colorant; and a zirconium compound including zirconium and at least one of an aromatic oxycarboxylic acid and a salt thereof, wherein the zirconium compound having a main diffraction peak (A) at a Bragg (2θ) angle of 5.5±0.3° and a diffraction intensity of from 2,000 to 15,000 cps when irradiated with a specific X-ray of CuKα.

20 Claims, 2 Drawing Sheets

TONER AND IMAGE FORMING METHOD USING THE TONER

BACKGROUND OF THE INVENTION

1. Field of the Invention

The present invention relates to a toner and an electrophotographic image forming method using the toner.

2. Discussion of the Background

Various image forming methods using electrophotographic methods have been suggested. Developing methods applied to these image forming methods are broadly classified into dry developing methods and wet developing methods. The dry developing methods are further classified into one-component developing methods and two-component developing methods. A toner for use in either of the methods has to be positively or negatively charged in accordance with a polarity of an electrostatic latent image.

It is most effective to include a charge controlling agent to maintain the charge of a toner. Particularly, colorless or white charge controlling agents are indispensable for a color toner. Specific examples of the colorless or white charge controlling agents include metallic salt compounds of salicylic acid derivatives disclosed in Japanese Patent Publication No. 55-42752 and Japanese Laid-Open Patent Publications Nos. 61-69073, 61-221756 and 9-124659; and compounds of aromatic dicarboxylate metallic salts disclosed in Japanese Laid-Open Patent Publication No. 57-111541. However, these are chrome compounds which are harmful to the environment, or are not sufficiently colorless or white for the color toner.

In order to solve these problems, zirconium, which is a main quadrivalent metal, compounds with quadrivalent cations, bivalent cations which are oxo complexes and salicylic acids or their derivatives have been studied. These are colorless charge controlling agents having good dispersibility with resins and capable of imparting good chargeability to the toner. However, there still remains a problem of deterioration of the chargeability in an environment of high temperature and humidity.

Japanese Patents Nos. 3135507 and 3154088 disclose ratios among metallic compounds, inorganic ions and carboxylic derivatives. Japanese Laid-Open Patent Publication No. 2001-66830 discloses a constitutional unit of a zirconium atom and an aromatic carboxylic acid. These enabled the toner to maintain high frictional charge quantity even in the environment of high temperature and humidity. However, when a carrier has a low charge quantity, charge quantity distribution of a developer becomes broad and a problem of background development of the resultant image is not solved yet.

Japanese Laid-Open Patent Publication No. 2000-147828 stipulates X-ray diffraction of metallic salts of amorphous or low-crystallinity aromatic compounds. Although re-transfer is improved, structures of amorphous or low-crystallinity charge controlling agents are changed due to a heat or a shearing strength in a kneading process of producing the toner. Therefore, conditions of producing the toner is considerably restricted to obtain desired quality thereof or a developer deteriorates because the amorphous or low-crystallinity charge controlling agents contaminates a carrier.

Because charge controlling agents having satisfactory properties and qualities are not available, an image forming method providing good quality images having high transfer efficiency without background development due to changes of the environment and charge quantity of the carrier is not established yet.

Because a toner image and a transfer sheet directly contact with each other in a heat roller fixing method, the transfer sheet draws much heat energy. Surface temperature of the roller largely changes according to a copy mode, a kind of transfer sheet and the environment, and affects image qualities after fixed.

When the surface temperature of the roller is sufficiently high, fixability of a toner image does not particularly have a problem. However, a melted viscosity of a resin in a toner lowers and the toner image largely expands on the transfer sheet after the roller passes the toner image. Therefore, thin line reproducibility deteriorates and image quality is impaired. When the surface temperature of the roller is low, the melted viscosity of the resin in the toner is high and the toner image does not easily expand on the transfer sheet after the roller passes the toner image. However, the fixability of the toner deteriorates.

Several suggestions have been made to solve this problem. Japanese Patent No. 2743476 discloses a roll fixing toner including a resin-coated core particle formed from a polyester resin and a wax having a polar group, wherein the melted viscosities of the polyester resin and wax are specified.

Japanese Laid-Open Patent Publication No. 3-122661 and Japanese Patent Publication No. 8-16804 disclose a film fixing toner including a specific polyester resin and a release agent, wherein the melted viscosity of the polyester resin at from 80 to 120° C., graph gradients of the melted viscosity and temperature, and the melted viscosity of the release agent are specified. Japanese Patent Publication No. 8-12459 discloses a film fixing capsule toner formed of a specific polyester resin and a release agent, wherein the melted viscosity of the polyester resin at from 80 to 120° C., graph gradients of the melted viscosity and temperature, and the melted viscosity of the release agent are specified. Japanese Patent Publication No. 7-82250 discloses a film fixing toner including a specific polyester resin, an organic metallic compound and a release agent, wherein the melted viscosity of the polyester resin at from 120 to 150° C., graph gradients of the melted viscosity and temperature, and the melted viscosity of the release agent are specified. Japanese Patent Publication No. 7-72809 discloses a toner formed of a styrene-acrylic resin, herein a relationship between the melted viscosity and temperature at from 110 to 130° C. is specified. Japanese Laid-Open Patent Publication No. 10-246989 discloses a toner including a specific charge controlling agent, wherein the average viscosity gradient is specified.

However, although these conventional technologies have effects on improvements of fixability of the toner image, improvements of the image quality such as volume and area variations of the toner image are not considered.

In accordance with higher image quality, the toner particle diameter tends to become smaller. When the toner particle diameter is small, a pressure between the fixing rollers is not easily applied to the toner particles, and it is difficult to uniformly fix the toner image. Particularly, a fixer having a low surface pressure has such difficulty. In addition, a thin transfer sheet further decreases the surface pressure, and deteriorates the toner image fixability and the resultant image quality. To the contrary, a thick transfer sheet increases the surface pressure, which crushes the toner image to emphasize nonuniformity thereof and the resultant image quality deteriorates. This frequently occurs when digital development is used, and independent dot reproducibility is largely affected. Therefore, a heat roller fixing method having higher heat efficiency than the other heat fixing methods is widely used, which includes one or two roller having an elastic layer.

Halftone image density has to be uniform, and microscopic unevenness thereof gives the impression of a rough image. The roughness is physically evaluated by granularity.

A noise of the image can be measured by Wiener Spectrum (WS) which is a frequency characteristic of the image density variation.

When the image density variation having an average value of 0 is f (x)

$$F(u)=\int f(x)\exp(-2\pi iux)dx \quad \text{formula 1}$$

$$WS(u)=F(u)^2 \quad \text{formula 2}$$

wherein, u is a spatial frequency.

The granularity is an integral value of the WS and Visual Transfer Function (VTF), and can be determined by the following formula:

$$GS=\exp(-1.8\langle D\rangle)\sim WS(u)^{1/2}VTF(u)du \quad \text{formula 3}$$

wherein, exp(−1.8<D>) is a correction coefficient between the density and a perceptive brightness by a human, and <D> is an average value of the density.

The granularity has a high correlation with a subjective evaluation of the image smoothness. The smaller the granularity, the smoother and better the image quality. To the contrary, the larger the granularity, the rougher and worse the image quality.

Because of these reasons, a need exists for a toner and an image forming method having high transferability and producing good images even in an environment of high temperature and humidity and when a carrier is insufficiently charged.

SUMMARY OF THE INVENTION

Accordingly, an object of the present invention is to provide a toner and an image forming method having high granularity and producing good images without deterioration of chargeability of the toner and a background development in an environment of high temperature and humidity in a heat roller fixing method of fixing a toner image by passing the toner image between two rollers.

Another object of the present invention is to provide a toner and an image forming method having high granularity and producing good images without a broad charge distribution of a developer and a background development even when a carrier is insufficiently charged in a heat roller fixing method of fixing a toner image by passing the toner image between two rollers.

Briefly these objects and other objects of the present invention as hereinafter will become more readily apparent can be attained by an image forming method including at least charging an image bearer with a charger; irradiating the image bearer with light to form an electrostatic latent image thereon; developing the electrostatic latent image with a toner to form a toner image on the image bearer; transferring the toner image onto a transfer sheet with a transferer; fixing the toner image on the transfer sheet upon application of heat; and cleaning a surface of the image bearer with a cleaner, wherein the toner includes at least a binder resin; a colorant; and a zirconium compound including zirconium and at least one of an aromatic oxycarboxylic acid and a salt thereof, said zirconium compound having a main diffraction peak (A) at a Bragg (2θ) angle of 5.5±0.3° and a diffraction intensity of from 2,000 to 15,000 cps when irradiated with a specific X-ray of CuKα.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
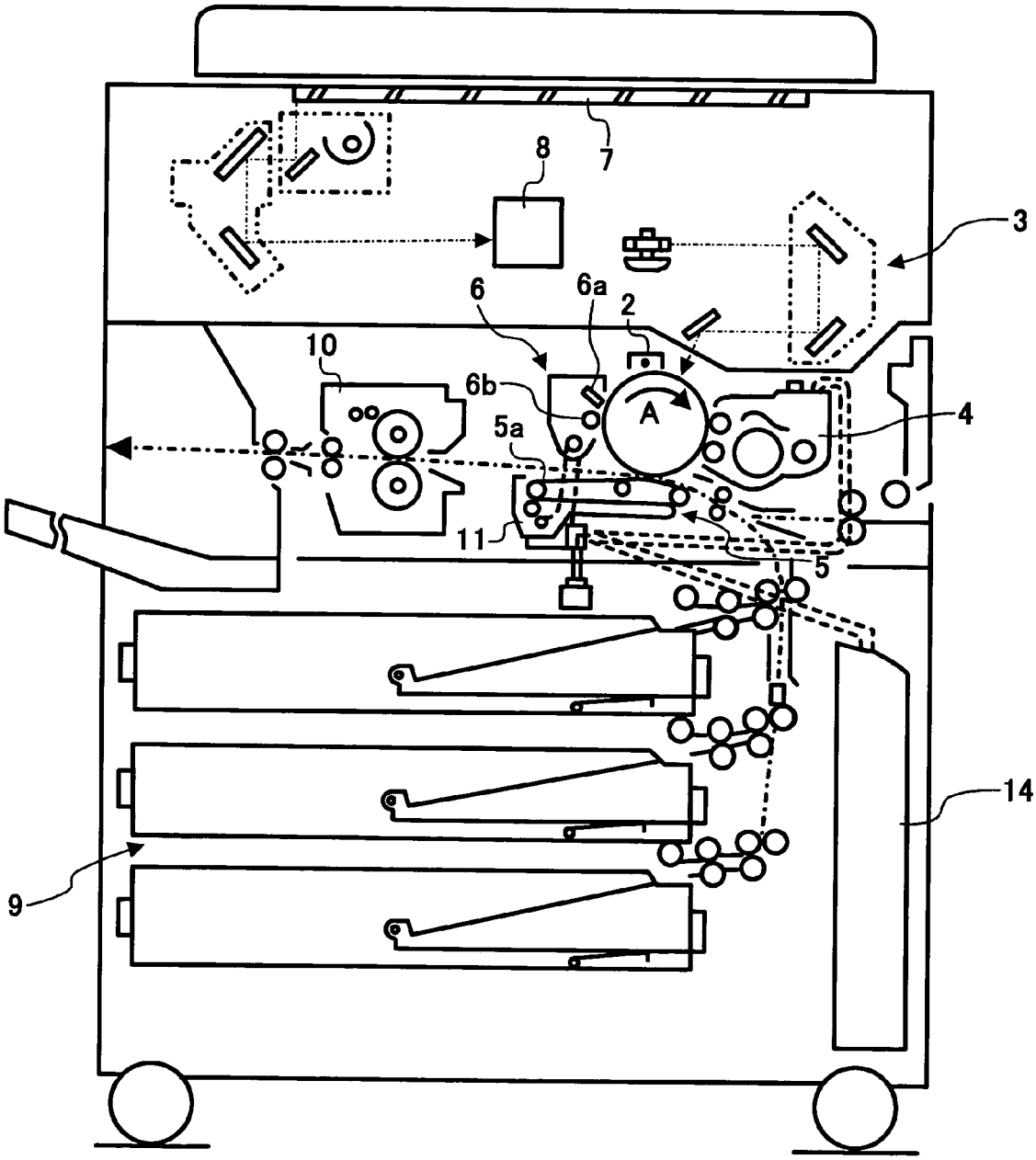
FIG. 1 is a schematic view illustrating a cross section of an embodiment of an image forming apparatus for use in the image forming method of the present invention.

Generally, the present invention provides a toner and an image forming method having high transferability and producing good images even in an environment of high temperature and humidity and when a carrier is insufficiently charged.

Hereinafter, the present invention will be explained, referring to the drawings.

FIG. 1 is a schematic view illustrating a cross section of an embodiment of an image forming apparatus for use in the image forming method of the present invention. A digital copier in FIG. 1 uses a known electrophotographic method and includes a drum-shaped photoreceptor 1. Around the photoreceptor 1, a charger 2, an irradiator 3, an image developer 4, a transferer 5, a cleaner 6 and a fixer 10, which perform an electrophotographic duplication process, are located along with a rotating direction indicated by an arrow A.

The irradiator 3 forms an electrostatic latent image on the photoreceptor 1 based on an image signal from a scanner 8 scanning an original located on an original setting table 7 on the copier.

The electrostatic latent image formed on the photoreceptor 1 was developed by the image developer 4 to form a toner image thereon, and the toner image is electrostatically transferred by the transferer 5 onto a transfer sheet fed by a paper feeder 9. The transfer sheet having the toner image thereon is transported to the fixer 10 fixing the toner image thereon and discharged out of the copier.

On the other hand, the photoreceptor 1 having a portion which is not transferred or a stain is cleaned by the cleaner 6 and ready for the following image forming step.

A toner for use in the image forming method of the present invention includes at least a binder resin, a colorant and a charge controlling agent. Hereinafter, the charge controlling agent will be explained.

The charge controlling agent is a zirconium compound formed of zirconium and an aromatic oxycarboxylic acid, and has the following crystal condition in a X-ray diffraction. The crystal has a main peak at a Bragg (2θ) angle of 5.5±0.3° when irradiated by a specific X-ray of CuKα and diffracted intensity of from 2,000 to 15,000 cps in a scanning speed of from 0.5 to 4°/min. Typically, in a X-ray diffraction measurement, a crystalline material has an individual diffraction peak in accordance with the crystal plane intervals due to the Bragg diffraction conditions. The diffracted intensity depends on the crystal conditions and crystallinity, and the hardness depends on the crystallinity in a certain scope. The main peak at a Bragg (2θ) angle of 5.5±0.3° is a peak due to a zirconium compound having an aromatic oxycarboxylic acid as a ligand. When the diffracted intensity is less than 2,000 cps, the zirconium compound has a low crystallinity and a bond therein is easily cut due to a heat and a shearing strength in a toner kneading process, resulting in deterioration of chargeability of the toner. Particularly, the chargeability of the toner noticeably deteriorates in an environment of high temperature and humidity. When the diffracted intensity is greater than 15,000 cps, negative polarity and agglutinability of the compound increase, and the compound is insufficiently dispersed with the other materials and the resultant toner does not have a sharp charge distribution. Therefore, a zirconium compound formed of zirconium and an aromatic oxycarboxylic acid, having a main peak at a Bragg (2θ) angle of 5.5±0.3° when irradiated by a specific X-ray of CuKα and diffracted intensity of from 2,000 to 15,000 cps in a scanning speed of from 0.5 to 4°/min, can impart high chargeability and a sharp charge distribution to a toner as a charge controlling agent.

In addition, a heat roller fixer fixing a toner image on a transfer sheet upon application of heat by passing the toner image through one or two rollers having elasticity can closely contact the surface of a toner image with the transfer sheet with less nonuniformity of the fixability, image density and glossiness. Therefore, a clear image having good granularity without a blur can be obtained after fixed.

Further, a charge controlling agent having a main peak A at a Bragg (2θ) angle of 5.5±0.3° and a sub-peak B at an angle of 31.6±0.3° when irradiated by a specific X-ray of CuKα and an intensity ratio of the peaks A/B of from 3 to 25 can stably charge a toner even in an environment of high temperature and humidity, and the resultant toner has more stable chargeability. An existence of the sub-peak B at an angle of 31.6±0.3° means a crystal plane interval is from 2.8553 to 2.8914 Å, which represents that electron density between the crystals is high. Therefore, a hydrogen bond between the crystal and a water molecule is difficult to occur, and deterioration of chargeability of the toner is prevented. When the intensity ratio of the peaks A/B is less than 3, the resultant toner does not have sufficient charge stability in an environment of high temperature and humidity. When greater than 25, mono-crystallinity due to the main peak A is insufficient. Therefore, poly-crystallinity increases and the resultant toner tends to have a broad charge distribution.

Further, when a toner has a volatile matter content not greater than 0.10% by weight at a temperature of from 100 to 150° C., deterioration of an elastic layer of the roller can be prevented and images having good granularity can be obtained for a long time. Namely, a slight amount of the residual volatile matter content of a toner at a temperature of from 100 to 150° C. on the roller after a toner image is fixed invades the elastic layer on the molecular level and plasticizes the elastic layer to be flexuous, resulting in deterioration thereof. In a copier practically used, it is considered that the slight amount of the residual volatile matter content of a toner at a temperature of from 100 to 150° C. on the roller gradually invades the elastic layer because the roller is constantly preheated at from 100 to 150° C. even when images are not produced. A volatile matter content at less than 100° C. instantly evaporates and does not remain in the copier, therefore it is considered that the content is not substantially involved in contamination of the elastic layer. Namely, when a toner has a volatile matter content not greater than 0.10% by weight at a temperature of from 100 to 150° C., the elastic roller more closely contacts the surface of a toner image with a transfer sheet without deterioration of the elasticity thereof, and images having good granularity with less nonuniformity of fixability, image density and glossiness can be produced. A toner more preferably has a volatile matter content not greater than 0.08%, and most preferably not greater than 0.05% by weight at a temperature of from 100 to 150° C. When the volatile matter content is greater than 0.10% by weight, the elastic layer of the roller deteriorates for a long-time use or storage. The volatile matter content at a temperature of from 100 to 150° C. includes low-molecular-weight by-products derived from an unreacted monomer of the after-mentioned binder resin compositions, residual low-molecular-weight contents of the other materials, and further low-molecular-weight contents dissolved and generated when a toner is produced, etc. An unreacted monomer of the binder resin, e.g., a styrene monomer does not remain and evaporates at not greater than 100° C., and is considered not to be involved in deterioration of the elastic layer.

Next, a fixer will be explained in detail.

Figure 2:
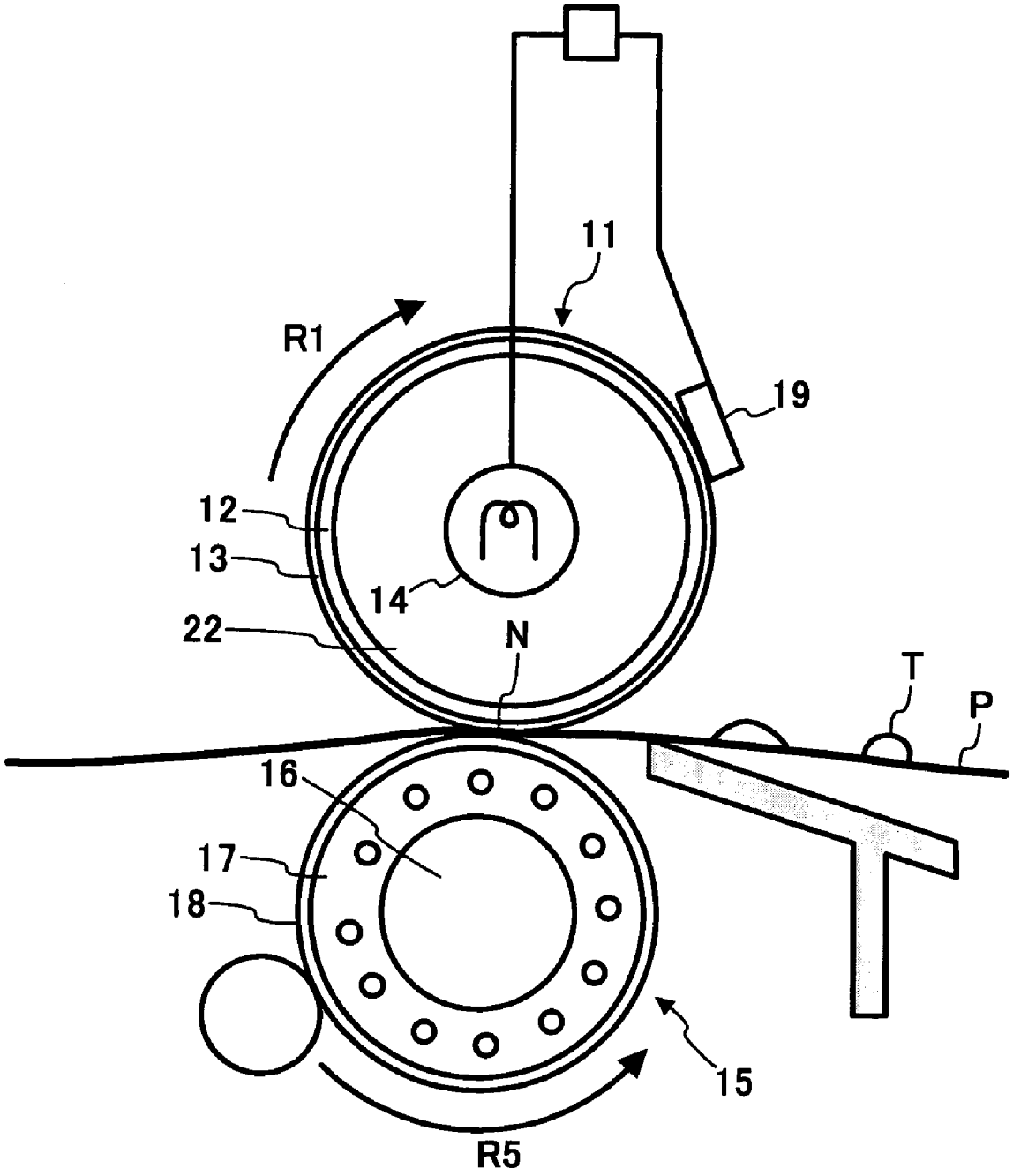
FIG. 2 is a schematic view illustrating a cross section of an embodiment of a heat roller fixer for use in the image forming method of the present invention.

FIG. 2 is a schematic view illustrating a cross section of an embodiment of a heat roller fixer for use in the image forming method of the present invention, including a fixing roller 11 having a heater 14 such as halogen lamps and a pressure roller 15 having an elastic layer 17 such as foamed silicone rubbers on a metal core 16, which is pressurized by the fixing roller 11. A release layer 18 formed of a PFA tube, etc. is formed on the elastic layer 17 of the pressure roller 15. The fixing roller 11 includes an elastic layer 12 formed of silicone rubbers, etc. on a metal core 22, and further a resin layer 13 formed of resins such as fluorocarbon resins having good releasability on the elastic layer 12 for the purpose of preventing adherence of a toner. The elastic layer 12 preferably has a thickness of from 100 to 500 μm in consideration of the resultant image quality and heat conduction efficiency in fixing the image. The resin surface layer 13 is formed of a PFA tube, etc. similarly to the pressure roller 15, and preferably has a thickness of from 10 to 50 μm in consideration of mechanical deterioration thereof. A temperature detector 19 is formed on a peripheral surface of the fixing roller 11, which detects a surface temperature thereof and controls the heater 14 to maintain a fixed temperature. The fixing roller 11 and pressure roller 16 contact with each other by a predetermined pressure to form a fixing nip portion N, and driven by a driver (not shown) and rotated in directions of R1 and R5 respectively such that the nip portion N sandwiches and transports a transfer sheet P. The fixing roller 11 is controlled to have a predetermined temperature by the heater 14, and a toner image T on the transfer sheet P is heated and melted while pressurized between the rollers. The toner image T is cooled after passing between the rollers and fixed on the transfer sheet P as a permanent image.

The elastic layer 17 of the pressure roller 15 has an outer diameter of 30 mm and a radial thickness of 6 mm, and the roller is coated with an electroconductive PFA tube. Hardness of a rubber of the elastic layer 17 is 42 HS. The metal core 22 of the fixing roller 11 is made of aluminium and has a radial thickness of 0.4 mm. A pressure of 88 N is applied to both ends of the rollers to form the nip N and a surface pressure is 9.3 N/cm$^2$.

As the aromatic oxycarboxylic acid for use in the present invention, known aromatic oxycarboxylic acids can be used, and compounds having the following formula (1) are preferably used in terms of charge imparting capability:

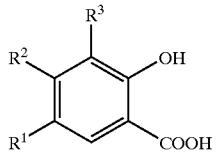

(1)

wherein, $R^1$, $R^2$ and $R^3$ independently represent a hydrogen atom, a chlorine atom, an alkyl group or aryl group having 1 to 10 carbon atoms, a hydroxy group, a carboxyl group and an alkoxy group having 1 to 10 carbon atoms.

Specific examples of the aromatic oxycarboxylic acids include compounds having the following formulae:

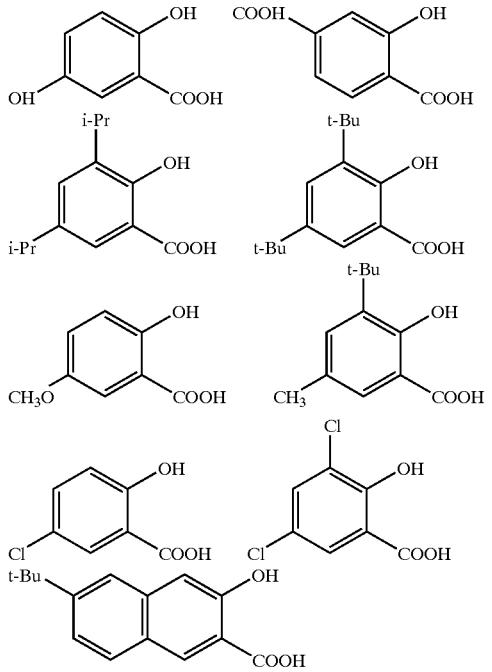

Among these compounds, 3,5-di-t-butyl salicylic acid is preferably used because of preventing deterioration of chargeability of the resultant toner in an environment of high temperature and humidity and contamination of a developing sleeve.

A charge controlling agent having an average particle diameter of from 0.2 to 4.0 $\mu$m has better dispersibility in a toner, and can impart a sharp charge distribution to the resultant toner and prevent contamination of a carrier and a developing sleeve. The average particle diameter can be measured by a laser diffraction type particle size measurer. When the average particle diameter is greater than 4.0 $\mu$m, the charge controlling agent has insufficient dispersibility with the other materials and remains as an agglutinated body in a toner, and the resultant toner has difficulty in obtaining a sharp charge distribution. When the average particle diameter is less than 0.2 $\mu$m, an apparent density of the charge controlling agent increases and a hopper supplying materials tends to be clogged in a process of producing a toner.

When a charge controlling agent is subjected to an extraction treatment so as to be dispersed in an ion exchanged water at a concentration of $1.5\times10^{-4}$ g/cm$^3$, the ion exchanged water preferably has a conductivity of from 5 to 20 S/cm. A charge controlling agent having the conductivity of from 5 to 20 S/cm can further increase negative chargeability of the resultant toner. When the conductivity is less than 5 S/cm, the resultant toner cannot obtain sufficient negative chargeability. When greater than 20 S/cm, a charge of the resultant toner tends to leak.

Any known binder resins can be used in the toner of the present invention. Specific examples of the resins include styrene resins such as polystyrene, poly-$\alpha$-methylstyrene, styrene-chlorostyrene copolymers, styrene-butadiene copolymers, styrene-vinylchloride copolymers, styrene-vinylacetate copolymers, styrene-maleic acid copolymers, styrene-ester acrylate copolymers, styrene-$\alpha$-methylchloroacrylate copolymers and styrene-acrylonitrile-ester acrylate copolymers (polymers or copolymers including styrene or styrene substituents); polyester resins; epoxy resins; vinylchloride resins; rosin-modified maleic acid resins; phenol resins; polyethylene resins; polypropylene resins; petroleum resins; polyurethane resins; ketone resins; ethylene-ethylacrylate copolymers, xylene resins; and polyvinylbutyral resins. Particularly, the polyester resins are preferably used.

The polyester resin can be obtained from a condensed polymerization between alcohol and a carboxylic acid. Specific examples of the alcohol include glycols such as ethyleneglycol, diethyleneglycol, triethyleneglycol and propyleneglycol; etherified bisphenol such as 1,4-bis (hydroxymethyl) cyclohexane and bisphenol A; units obtained form a dihydric alcohol monomer; and units obtained from a tri-or-more hydric alcohol monomer. Specific examples of the carboxylic acids include units obtained from a dihydric organic-acid monomer such as maleic acid, fumaric acid, phthalic acid, isophthalic acid, terephthalic acid, succinic acid and malonic acid; and units obtained from a tri-or-more hydric carboxylic-acid monomer such as 1,2,4-benzenetricarboxylic acid, 1,2,5-benzenetricarboxylic acid, 1,2,4-cyclohexanetricarboxylic acid, 1,2,4-naphthalanetricarboxylic acid, 1,2,5-hexanetricarboxylic acid, 1,3-dicarboxyl-2-methylenecarboxypropane and 1,2,7,8-octantetracarboxylic acid. The polyester resin preferably has a glass transition temperature (Tg) of from 58 to 75° C.

These resins can be used alone or in combination. In addition, manufacturing methods of these resins are not particularly limited and any methods such as mass polymerization, solution polymerization, emulsion polymerization and suspension polymerization can be used.

The charge controlling agents preferably has a content of from 0.5 to 5 parts by weight per 100 parts by weight of the binder resin. When less than 0.5 parts by weight, the resultant toner does not have sufficient negative chargeability. When greater than 5 parts by weight, problems such as contamination of a developing sleeve tend to occur.

Further, the binder resin preferably includes the polyester resin of from 50 to 100% by weight, and the polyester resin preferably has an acid value of from 5 to 25 mgKOH/g. The polyester resin having an acid value of from 5 to 25 mgKOH/g can improve negative chargeability of the resultant toner because a free carboxylic group has electron receptibity. In addition, the aromatic oxycarboxylic acid or salt is bonded with a carboxylic group of the polyester resin with a hydrogen atom, and a pseudo-bridge is formed.

Consequently, the resultant toner has more viscosity and a toner image is not collapsed, and an image having better granularity can be obtained. When the acid value is greater than 25 mgKOH/g, charge stability of the resultant toner in an environment of high humidity deteriorates.

Any pigments and dyes conventionally used as colorants for a toner can be used as a colorant included in the toner for use in the present invention. Specific examples of the colorants include carbon black, lamp black, iron black, ultramarine blue, nigrosin dyes, aniline blue, chalco Oil Blue, oil black, azo oil black, etc. However, these are not limited thereto. The colorant preferably has a content of from 1 to 10, and more preferably from 3 to 7 parts by weight based on total weight of resins used in a toner.

A wax can be used in the toner for use in the present invention to improve releasability of the toner when fixed. Specific examples of the waxes include polyolefin waxes such as polypropylene wax and polyethylene wax; and natural waxes such as candelilla wax, rice wax and carnauba wax.

The wax preferably has a content of from 0.5 to 10 parts by weight based on total weight of resins used in a toner.

An additive can optionally be included in the toner for use in the present invention. Specific examples of the additives include silica, aluminium oxides, titanium oxides. As a fluidizer, a hydrophobized silica or a rutile type fine-particle titanium dioxide preferably having an average particle diameter of from 0.001 to 1 $\mu$m, and more preferably from 0.005 to 0.1 $\mu$m can optionally be used. Particularly, an organic silane surface-treated silica or titania is preferably used. The additive preferably has a content of from 0.1 to 5%, and more preferably from 0.2 to 2% by weight based on total weight of a toner.

In addition, when the present invention is applied in an image forming method including a dry two-component developing process, as a carrier for use in the developer, a powder having including glass, iron, ferrite, nickel zircon, silica, etc. as a main component and having a particle diameter of from about 30 to 1,000 $\mu$m or the powder coated with styrene-acrylic resins, silicone resins, polyamide resins, polyvinylidene fluoride resins, etc. can optionally be used.

Hereinafter, a method of producing a toner for use in the present invention will be explained.

The method includes a mixing process, a kneading process upon application of heat, a pulverizing process and a classifying process of a developer including a binder resin, a charge controlling agent and a colorant. In addition, the methods include a method of recycling a powder besides particles to be used for a toner in a pulverizing or a classifying process into a mechanical mixing process or a kneading process upon application of heat. The powder besides particles to be used for a toner (by-product) means fine particles and coarse particles besides toner particles having a desired particle diameter in the pulverizing process or the following classifying process. When such a by-product is mixed or kneaded upon application of heat with original materials, the by-product is preferably has a content of 1 part by weight or 50 parts by weight based on total weight of the toner materials.

A conventional mixer having a rotating blade can be used in the mechanical mixing process of a developer including at least a binder resin, a charge controlling agent, a colorant and the by-product in conventional conditions without any particular conditions.

After the mixing process, the mixture is kneaded upon application of heat in a kneader. A uniaxial or biaxial continuous kneader and a batch type kneader with a roll mill can be used. It is important that the kneading process is performed in proper conditions so as not to cut a molecular chain of the binder resin. Specifically, a temperature of the kneading process upon application of heat is determined in consideration of a softening point of the binder resin. When the temperature is lower than the softening point, the molecular chain of the binder resin is considerably cut. When higher than the softening point, the dispersion does not proceed well.

After the kneading process upon application of heat, the mixture is pulverized. In this pulverizing process, the mixture is preferably crashed, and then pulverized. The mixture is preferably pulverized by being crashed to a collision board in a jet stream, and pulverized by being passed through a narrow gap between a mechanically rotating rotor and a stator.

After the pulverizing process, the pulverized material is classified by a centrifugal force, etc. in a stream of air to prepare a toner having a predetermined particle diameter, e.g., of from 5 to 20 $\mu$m.

In addition, an external additive, i.e., inorganic fine particles such as hydrophobic silica fine powders can be added to the thus prepared toner. A conventional powder mixer can be used to mix the external additive, and is preferably equipped with a jacket to control an inside temperature. In order to change a load to the external additive, the external additive may be added on the way of mixing process or gradually added to the toner. As a matter of course, the number of revolutions, a rolling speed, a time of mixing and a temperature of the mixer may be changed. A large load at the beginning and a small load later may be applied to the additive, and vice versa. Specific examples of the mixers include a V-type mixer, a locking mixer, a Loedige Mixer, a Nauta Mixer, a Henschel Mixer, etc.

The thus prepared toner has high chargeability, a sharp charge distribution and very good charge stability in an environment of high temperature and humidity. Therefore, the image forming method of the present invention using the toner can produce high quality images without background development because of having high transferability.

Recently, a charger, a transferer and a cleaner contact a photoreceptor to decrease ozone, and a charging roller or a charging blade, a transfer belt and a cleaning blade are used. Therefore, a toner tends to adhere to these members because they directly contact a photoreceptor. However, a toner for use in the image forming method of present invention is preferably used in such a method. This is because the number of reversely charged toner is small as the toner has a sharp charge distribution, and an amount of a residual toner is small as the toner has high transferability. In addition, as one of a mechanism of the toner adherence, an agglutinated charge controlling agent on a surface of the toner occasionally separates therefrom and becomes a core of progress of the toner adherence. However, because a charge controlling agent for use in the image forming method of the present invention has good dispersibility with other materials of the toner, the charge controlling agent does not agglutinate on the surface of the toner and does not become a core of the toner adherence. Therefore, toner adherence does not occur even in a contact charging process, a contact transfer process and a contact cleaning process.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Prior to the examples, a method of measuring properties of a charge controlling agent for use in the image forming method of the present invention will be explained.

<X-ray diffraction>

X-ray diffractometer RINT1100 from Hitachi, Ltd. and CuKα ray were used in the following conditions:

X-ray tube bulb: Cu, tube voltage: 50 kV, tube current: 30 mA and Scanning speed: 2°/min <Average particle diameter>

A few drops of a detergent, e.g., Contaminon from Wako Pure Chemical industries, Ltd. were included in 10 $cm^3$ of ion exchanged water in a container, and 0.01 g of a charge controlling agent was included in the mixture and the mixture was dispersed for 1 min by a supersonic disperser to prepare a dispersion liquid. The dispersion liquid was measured by a laser diffraction type granularity measurer SALID from Shimadzu Corp.

<Conductivity>

0.003 g of a charge controlling agent was included in 20 $cm^3$ of ion exchanged water in a container, and the mixture was dispersed by a supersonic disperser for 10 min. The dispersion liquid was left for 10 hrs and 15 $cm^3$ of a clear supernatant liquid thereof was measured by a conductivity meter.

Examples 1 to 10

<Charge controlling agent 1>

20 to 30 parts of 5-methoxysalicylate and 20 to 30 parts of an aqueous solution of sodium hydrate having a concentration of 25% were dissolved in 300 to 400 parts of water, and the mixture was heated to have a temperature of 50° C. at a programming rate of from 5 to 15° C./min. An aqueous solution in which 15 to 25 parts of zirconium oxychloride were dissolved in 80 to 100 parts of water was dropped in the mixture while stirred. After the mixture was stirred at the same temperature for 1 hr, the mixture was cooled to have a room temperature at a programming rate of from 5 to 15° C./min. 5 to 8 parts of the aqueous solution of sodium hydrate having a concentration of 25% was included in the mixture to have a pH of from 7.5 to 8.0. A precipitated crystal was filtered, washed with water and dried to prepare 20 to 35 parts of a white crystal of a zirconium compound.

The measurement results of the X-ray diffractions, average particle diameters and conductivity of the respective charge controlling agents are shown in Table 1.

<Toner formulation>

The following components were kneaded by a biaxial extruder, and pulverized and classified to prepare a mixture having an average particle diameter of from 6 to 8 μm.

| | |
|---|---|
| Styrene-n-butylacrylate copolymer | 100 |
| Carbon black #44 (from Mitsubishi Chemical Corp.) | 10 |
| Carnauba wax | 5 |
| Charge controlling agent 1 | refer to Table 1 |

Then, a silica powder (R-972 from Clariant (Japan) KK) was mixed in the mixture by a Henschel Mixer to prepare toners.

The toners were mixed with a carrier formed of ferrite particles having an average particle diameter of 50 μm coated with a silicone resin such that the toners have a concentration of 4.0% to prepare developers. The toner properties were measured in the following conditions using the respective developers. The results are shown in Table 1.

<Charge amount of the toner>

The charge amount of the toner was measured by a blow-off powder charge amount measurer (TB-200 from Toshiba Chemical Corp.) in an environment of high temperature and humidity (30° C. and 90%), and in an environment of room temperature and humidity (25° C. and 65%).

<Half width of charge distribution>

The charge amount of the developer was measured by an analyzer EST-1 from Hosokawa Micron Corp, and the half width of the charge distribution thereof was determined.

In addition, the following image evaluation was performed using the developers. The results are shown in Table 1.

After 50,000 images were produced imagio 420 from Ricoh Company, Ltd. in an environment of a room temperature and humidity (18 to 27° C. and 30 to 70%), the charge amount and distribution of the developers were measured. Further, an image transferability, a contamination of a developing sleeve and background development were evaluated under the following standard, and the imagio 420 was equipped with a charging roller, a transfer belt and a cleaning blade.

<Background development>

A: Very good. No background development.

B: Good. A slight background development.

C: Acceptable. Not a practical problem although background development occurred.

D: Poor. A serious background development.

<Transferability>

A square solid image of 10 cm×10 cm was produced. The transferability was determined from a toner amount W1 on a photoreceptor before transfer and a toner amount W5 on a transfer material after transfer as follows:

transferability (%)=(W5/W1)×100

<Contamination of developing sleeve>

Level 1: Very good. No toner contamination.

Level 2: Good. Slight toner contamination.

Level 3: Acceptable. Not a practical image problem although toner contamination occurred.

Level 4: Poor. Toner contamination caused a void in a solid image.

Examples 11 and 12

The procedures of preparation for the toners in Examples 1 to 10 were repeated except for changing 100 parts of the styrene-n-butylacrylate copolymer into 100 parts of a polyester resin having an acid value of 20 mg KOH/g to prepare a toner of Example 11, and 50 parts of the styrene-n-butylacrylate copolymer and 50 parts of the polyester resin having an acid value of 20 mg KOH/g to prepare a toner of Example 12. Properties of the thus prepared toners were measured and the resultant images were evaluated. The results are shown in Table 1.

Examples 13 to 15

The procedures of preparation for toners in Examples 1 to 10 were repeated except for changing 100 parts of the styrene-n-butylacrylate copolymer into 20 parts of the styrene-n-butylacrylate copolymer and 80 parts of a polyester resin having an acid value of 15 mg KOH/g, and changing the charge controlling agent 1 to the following charge controlling agent 2 to prepare toners of Examples 13 to 15. Properties of the thus prepared toners were measured and the resultant images were evaluated. The results are shown in Table 1.

<Charge controlling agent 2>

30 to 40 parts of 3,5-di-butyl salicylic acid and 15 to 28 parts of an aqueous solution of sodium hydrate having a concentration of 25% were dissolved in 300 to 400 parts of water, and the mixture was heated to have a temperature of 50° C. at a programming rate of from 5 to 15° C./min. An aqueous solution in which 15 to 26 parts of zirconium oxychloride were dissolved in 70 to 120 parts of water was dropped in the mixture while stirred. After the mixture was stirred at the same temperature for 1 hr, the mixture was cooled to have a room temperature at a programming rate of from 5 to 15° C./min. 5 to 9 parts of the aqueous solution of sodium hydrate having a concentration of 25% was included in the mixture to have a pH of from 7.5 to 8.0. A precipitated crystal was filtered, washed with water and dried to prepare 20 to 40 parts of a white crystal of a zirconium compound.

TABLE 1

| | CCA | | | | | Polyester Resin | |
|---|---|---|---|---|---|---|---|
| | Peak A intensity | Intensity Ratio (A/B) | Average particle diameter (μm) | Conductivity (S/cm) | Content 1) (parts by weight) | Content 2) (wt %) | Acid value (mg KOH/g) |
| Ex. 1 | 2000 | 2.5 | 5.2 | 22.0 | 0.2 | 0 | — |
| Ex. 2 | 15000 | 28.0 | 6.3 | 3.0 | 0.4 | 0 | — |
| Ex. 3 | 2000 | 3.0 | 4.2 | 4.5 | 5.5 | 0 | — |
| Ex. 4 | 8000 | 25.0 | 0.15 | 2.2 | 0.3 | 0 | — |
| Ex. 5 | 6600 | 5.0 | 0.2 | 3.5 | 5.1 | 0 | — |
| Ex. 6 | 12000 | 20.0 | 4.0 | 3.5 | 0.1 | 0 | — |
| Ex. 7 | 7200 | 8.0 | 0.5 | 5.0 | 0.3 | 0 | — |
| Ex. 8 | 10000 | 12.0 | 3.0 | 20.0 | 0.3 | 0 | — |
| Ex. 9 | 3500 | 8.0 | 0.7 | 7.0 | 0.5 | 0 | — |
| Ex. 10 | 5200 | 16.0 | 2.8 | 10.0 | 5.0 | 0 | — |
| Ex. 11 | 9600 | 25.0 | 1.8 | 16.0 | 1.2 | 100 | 20 |
| Ex. 12 | 2500 | 21.0 | 0.3 | 12.0 | 2.0 | 50 | 20 |
| Ex. 13 | 4500 | 6.0 | 1.0 | 6.0 | 3.0 | 80 | 15 |
| Ex. 14 | 14000 | 5.0 | 2.0 | 25.0 | 2.0 | 80 | 15 |
| Ex. 15 | 7700 | 14.0 | 2.1 | 6.0 | 1.0 | 80 | 15 |

| | Toner charge amount at room temperature & humidity | Toner charge amount at high temperature & humidity | After 50,000 images were produced | | | |
|---|---|---|---|---|---|---|
| | | | Half width of charge distribution | Background development | Transferability | Sleeve contamination |
| Ex. 1 | 35 | 30 | 8.0 | C | 90 | 2 |
| Ex. 2 | 40 | 33 | 7.5 | C | 91 | 2 |
| Ex. 3 | 35 | 32 | 8.2 | C | 92 | 3 |
| Ex. 4 | 37 | 35 | 7.8 | C | 91 | 2 |
| Ex. 5 | 35 | 31 | 7.0 | B | 93 | 3 |
| Ex. 6 | 42 | 38 | 6.8 | B | 93 | 2 |
| Ex. 7 | 45 | 42 | 6.5 | B | 95 | 2 |
| Ex. 8 | 45 | 43 | 6.3 | B | 94 | 2 |
| Ex. 9 | 47 | 44 | 5.8 | B | 95 | 2 |
| Ex. 10 | 46 | 43 | 5.6 | B | 96 | 2 |
| Ex. 11 | 48 | 44 | 5.0 | B | 95 | 2 |
| Ex. 12 | 48 | 45 | 4.8 | B | 99 | 2 |
| Ex. 13 | 48 | 46 | 3.9 | A | 98 | 1 |
| Ex. 14 | 47 | 44 | 3.5 | A | 99 | 1 |
| Ex. 15 | 48 | 46 | 3.7 | A | 98 | 1 |

CCA: Charge controlling agent
1): A content (parts by weight) of the charge controlling agent per 100 parts by weight of the binder resin.
2) A content (weight %) of the polyester resin in the binder resin.

Any of the toners in Examples 1 to 15 including the charge controlling agent having a peak A intensity of from 2,000 to 15,000 at a Bragg (2θ) angle of 5.5±0.3° when irradiated by a specific X-ray had a high charge amount and no problem of decrease of the charge amount in an environment of high temperature and humidity. In addition, a small half width of the charge distribution after 50,000 images were produced proved that the toner had a uniform and good chargeability. Even after 50,000 images were produced, the background development was not less than level C which was not a problem for a practical use, the transferability was not less than 90% and the developing sleeve contamination was not less than level 3 which did not cause an image problem.

Further, the chargeability of the toners having a ratio (A/B) between the main peak A at 5.5±0.3° and a sub-peak B at 31.6±0.3° of from 3 to 25 in Examples 3 to 15 was improved in an environment of high temperature and humidity.

The toners including the charge controlling agent having an average particle diameter of from 0.2 to 4.0 μm in Examples 5 to 15, which had good dispersibility in the toner, had better charge distribution and background development of not less than B level.

The toners including the charge controlling agent having a conductivity of from 5 to 20 (S/cm) when abstracted in an ion exchanged water in Examples 7 to 15 had more charge amounts and improved transferability.

The toners including the charge controlling agent having a content of from 0.5 to 5 parts by weight per 100 parts by weight of the binder resin in Examples 9 to 15 had furthermore charge amounts and improved transferability.

In addition, the toners including a polyester resin having an acid value not greater than 20 mg KOH/g in an amount of 50 to 100% by weight in the binder resin had more charge amounts and improved transferability.

Further, the toners using 3,5-di-y-butylsalicylic acid as a charge controlling agent in Examples 13 to 15 had high charge amounts, quite a sharp charge distribution, no background development, quite a high transferability, and therefore, produced high-quality images without developing sleeve contamination.

There was no toner fusion and adherence on the charging roller, transfer belt and cleaning blade in Examples 1 to 15.

Examples 16 to 20

20 to 30 parts of 5-methoxysalicylate and 20 to 30 parts of a caustic soda having a concentration of 25% were dissolved in 300 to 400 parts of water, and the mixture was heated to have a temperature of 50° C. at a programming rate of from 5 to 15° C./min. An aqueous solution in which 15 to 25 parts of zirconium oxychloride were dissolved in 80 to 100 parts of water was dropped in the mixture while stirred. After the mixture was stirred at the same temperature for 1 hr, the mixture was cooled to have a room temperature at a programming rate of from 5 to 15° C./min. 5 to 8 parts of the caustic soda having a concentration of 25% was included in the mixture to have a pH of from 7.5 to 8.0. A precipitated crystal was filtered, washed with water and dried to prepare 20 to 35 parts of a white crystal of a zirconium compound including 5-methoxysalicylate. The zirconium compound had a main peak at a Bragg (2θ) angle of 5.5±0.3° when irradiated by a specific X-ray of CuKα and diffracted intensity thereof was as per Table 2 in a scanning speed of from 0.5 to 4°/min.

<Toner formulation>

The following components were kneaded by a biaxial extruder, and pulverized and classified to prepare a mixture having a desired weight-average average particle diameters mentioned in Table 2.

| | |
|---|---|
| Styrene-n-butylacrylate copolymer | 100 |
| Carbon black #44 (from Mitsubishi Chemical Corp.) | 10 |
| Carnauba wax | 4 |
| The above mentioned zirconium compound including 5-methoxy salicylic acid | 2 |

Then, a silica powder (R-972 from Clariant (Japan) KK) was mixed in the mixture by a Henschel Mixer to prepare toners.

The toners were mixed with a carrier formed of ferrite particles having an average particle diameter of 50 μm coated with a silicone resin such that the toners have a concentration of 4.0% to prepare developers.

The toner properties were measured in the following conditions using the respective developers. The results are shown in Table 2.

1. The charge amount of the toner was measured by a blow-off powder charge amount measurer TB-200 from Toshiba Chemical Corp. in an environment of high temperature and humidity 30° C. and 90%, and in an environment of room temperature and humidity 25° C. and 65%.
2. The fixer shown in FIG. 2 was installed in imagio MF6550 from Ricoh Company, Ltd., and after 50,000 images were produced in an environment of high temperature and humidity 30° C. and 90%, the charge amount the toner was measured. In addition, the granularity thereof was measured by the following method.

First, the fixer of the imagio MF6550 was modified to have an elastic layer. 50,000 images of Ricoh standard printer test chart were produced by the apparatus. Then, after the apparatus was standby for 1 hr, 50,000 images were further produced. The halftone part thereof was scanned by GenaScan 5000 scanner from Dainippon Screen Mfg. Co., Ltd. at 1,000 dpi to obtain the image data. The image data were converted into the image density distribution, and the granularity of the image was determined by the above-mentioned formula 3.

Example 21

The procedures of preparation and evaluation for the toner in Examples 16 to 20 were repeated except for changing the charge controlling agent to the following charge controlling agent.

30 to 40 parts of 3,5-di-tertiary-butylsalicylic acid and 15 to 28 parts of a caustic soda having a concentration of 25% were dissolved in 300 to 400 parts of water, and the mixture was heated to have a temperature of 50° C. at a programming rate of from 5 to 15° C./min. An aqueous solution in which 15 to 26 parts of zirconium oxychloride were dissolved in 70 to 120 parts of water was dropped in the mixture while stirred. After the mixture was stirred at the same temperature for 1 hr, the mixture was cooled to have a room temperature at a programming rate of from 5 to 15° C./min. 5 to 9 parts of the caustic soda having a concentration of 25% was included in the mixture to have a pH of from 7.5 to 8.0. A precipitated crystal was filtered, washed with water and dried to prepare 20 to 40 parts of a white crystal of a zirconium compound including 3,5-di-tertiary-butylsalicylic acid. The zirconium compound had a main peak at a Bragg (2θ) angle of 5.5±0.3° when irradiated by a specific X-ray of CuKα and diffracted intensity thereof was as per Table 2 in a scanning speed of from 0.5 to 4°/min.

Example 22

The procedures of preparation and evaluation for the toner in Example 21 were repeated except for changing 100 parts of the styrene-n-butylacrylate copolymer into 50 parts of the styrene-n-butylacrylate copolymer and 50 parts of a polyester resin having an acid value of 25 mg KOH/g. The results are shown in Table 2.

Example 23

The procedures of preparation and evaluation for the toner in Examples 21 were repeated except for changing the styrene-n-butylacrylate copolymer into a polyester resin having an acid value of 5 mg KOH/g. The results are shown in Table 2.

Example 24

The procedures of preparation and evaluation for the toner in Examples 23 were repeated except for changing the charger into a charging roller. The results are shown in Table 2.

Examples 25 to 27

The procedures of preparation and evaluation for the toner in Examples 24 were repeated except for changing a content of the polyester resin as mentioned in Table 2 and the transferer into a transfer belt.

TABLE 2

| | Ex. 16 | Ex. 17 | Ex. 18 | Ex. 19 | Ex. 20 | Ex. 21 |
|---|---|---|---|---|---|---|
| Peak A intensity | 2,000 | 15,000 | 3,800 | 5,600 | 13,000 | 10,000 |
| Intensity Ratio (A/B) | 2.5 | 26 | 3 | 25 | 5 | 20 |
| Volatile matter content in toner (weight %) | 0.25 | 0.15 | 0.12 | 0.22 | 0.10 | 0.08 |
| Polyester resin content (wt. %) | 0 | 0 | 0 | 0 | 0 | 0 |
| Polyester resin Acid value (mg KOH/g) | — | — | — | — | — | — |
| Charger | Charger | Charger | Charger | Charger | Charger | Charger |
| Transferer | Charger | Charger | Charger | Charger | Charger | Charger |
| Charge amount of toner in room temperature and humidity (μc/g) | 35 | 40 | 35 | 37 | 35 | 42 |
| Charge amount of toner in high temperature and humidity (μc/g) | 30 | 33 | 32 | 35 | 31 | 38 |
| Granularity after 50,000 images | 0.80 | 0.75 | 0.72 | 0.70 | 0.65 | 0.60 |

| | Ex. 22 | Ex. 23 | Ex. 24 | Ex. 25 | Ex. 26 | Ex. 27 |
|---|---|---|---|---|---|---|
| Peak A intensity | 8,200 | 11,000 | 3,500 | 5,200 | 9,600 | 2,500 |
| Intensity Ratio (A/B) | 8 | 12 | 8 | 16 | 25 | 21 |
| Volatile matter content in toner (weight %) | 0.05 | 0.09 | 0.03 | 0.04 | 0.10 | 0.07 |
| Polyester resin content (wt. %) | 50 | 100 | 100 | 80 | 80 | 80 |
| Polyester resin Acid value (mg KOH/g) | 25 | 5 | 5 | 20 | 15 | 10 |
| Charger | Charger | Charger | Roller | Roller | Roller | Roller |
| Transferer | Charger | Charger | Charger | Roller | Roller | Roller |
| Charge amount of toner in room temperature and humidity (μc/g) | 45 | 45 | 47 | 46 | 48 | 48 |
| Charge amount of toner in high temperature and humidity (μc/g) | 42 | 43 | 44 | 43 | 44 | 45 |
| Granularity after 50,000 images | 0.53 | 0.50 | 0.46 | 0.43 | 0.40 | 0.42 |

Similarly to Examples 1 to 15, the toners including the charge controlling agent having a peak A intensity of from 2,000 to 15,000 at a Bragg (2θ) angle of 5.5±0.3° when irradiated by a specific X-ray in Examples 16 to 27 had a high charge amount and no problem of decrease of the charge amount in an environment of high temperature and humidity. In addition, even after 50,000 images were produced, the images had good granularity and quality.

Further, there was no toner fusion and adherence on the charging roller, transfer belt and cleaning blade in Examples 16 to 27, either.

Comparative Examples 1 to 5

<Charge controlling agent 3>

5 to 28 parts of 5-methoxysalicylate and 5 to 22 parts of an aqueous solution of sodium hydrate having a concentration of 25% were dissolved in 350 to 450 parts of water, and the mixture was heated to have a temperature of 50° C. An aqueous solution in which 10 to 12 parts of zirconium oxychloride were dissolved in 90 parts of water was dropped in the mixture while stirred. After the mixture was stirred at the same temperature for 30 min, the mixture was cooled to have a room temperature at a programming rate of from 1 to 3° C./min. Approximate 6 parts of the aqueous solution of sodium hydrate having a concentration of 25% was included in the mixture to have a pH of from 7.5 to 8.0. A precipitated crystal was filtered, washed with water and dried to prepare 20 to 30 parts of a white crystal of a zirconium compound.

The measurement results of the X-ray diffractions, average particle diameters and conductivity of the respective charge controlling agents are shown in Table 3.

<Toner formulation>

The following components were kneaded by a biaxial extruder, and pulverized and classified to prepare a mixture having an average particle diameter of from 6 to 8 μm.

| | |
|---|---|
| Styrene-n-butylacrylate copolymer | 80 |
| Polyester resin having an acid value of 12 mg KOH/g | 20 |
| Carbon black #44 (from Mitsubishi Chemical Corp.) | 10 |
| Carnauba wax | 4 |
| Charge controlling agent 3 | refer to Table 3 |

Then, a silica powder (R-972 from Clariant (Japan) KK) was mixed in the mixture by a Henschel Mixer to prepare toners.

The toners were mixed with a carrier formed of ferrite particles having an average particle diameter of 50 μm coated with a silicone resin such that the toners have a concentration of 4.0% to prepare developers. The toner properties were measured in the same method of Examples 1 to 10 using the respective developers. The results are shown in Table 3.

TABLE 3

| | CCA | | | | | Polyester Resin | |
|---|---|---|---|---|---|---|---|
| | Peak A intensity | Intensity Ratio (A/B) | Average particle diameter (μm) | Conductivity (S/cm) | Content 1) (parts by weight) | Content 2) (wt %) | Acid value (mg KOH/g) |
| Com. Ex. 1 | 1,900 | 20.0 | 3.8 | 18.0 | 5.0 | 80 | 12 |
| Com. Ex. 2 | 16,000 | 5.0 | 0.5 | 6.0 | 1.0 | 80 | 12 |
| Com. Ex. 3 | 1,800 | 12.0 | 2.2 | 14.0 | 0.5 | 80 | 12 |
| Com. Ex. 4 | 15,500 | 18.0 | 1.0 | 10.0 | 2.0 | 80 | 12 |
| Com. Ex. 5 | 1,400 | 20.0 | 3.5 | 15.0 | 3.0 | 80 | 12 |

| | Toner charge amount at room temperature & humidity | Toner charge amount at high temperature & humidity | After 50,000 images were produced: Half width of charge distribution | Background development | Transferability | Sleeve contamination |
|---|---|---|---|---|---|---|
| Com. Ex. 1 | 28 | 23 | 9.5 | D | 85 | 4 |
| Com. Ex. 2 | 25 | 20 | 10.0 | D | 88 | 4 |
| Com. Ex. 3 | 22 | 18 | 9.8 | D | 87 | 4 |
| Com. Ex. 4 | 26 | 21 | 8.8 | D | 86 | 4 |
| Com. Ex. 5 | 23 | 20 | 9.2 | D | 83 | 4 |

CCA: Charge controlling agent
1): A content (parts by weight) of the charge controlling agent per 100 parts by weight of the binder resin.
2): A content (weight %) of the polyester resin in the binder resin.

Any of the toners in Comparative Examples 1 to 5 including the charge controlling agent not having a peak A intensity of from 2,000 to 15,000 at a Bragg (2θ) angle of 5.5±0.3° when irradiated by a specific X-ray had a low charge amount. In addition, a large half width of the charge distribution after 50,000 images were produced proved that the toner had an uneven chargeability. After 50,000 images were produced, the background development was level D, the transferability was low at not greater than 88% and the developing sleeve contamination was level 4 which caused an image problem.

The charging roller was contaminated in Comparative Example 1, and particularly an image developed around the contaminated portion had much background development. In addition, both ends of the transfer belt in Comparative Example 5 were contaminated.

Comparative Examples 6 to 10

5 to 28 parts of 5-methoxysalicylate and 5 to 22 parts of a caustic soda having a concentration of 25% were dissolved in 350 to 450 parts of water, and the mixture was heated to have a temperature of 50° C. An aqueous solution in which 10 to 12 parts of zirconium oxychloride were dissolved in 90 parts of water was dropped in the mixture while stirred. After the mixture was stirred at the same temperature for 30 min, the mixture was cooled to have a room temperature at a programming rate of from 1 to 3° C./min. Approximate 6 parts of the caustic soda having a concentration of 25% was included in the mixture to have a pH of from 7.5 to 8.0. A precipitated crystal was filtered, washed with water and dried to prepare 20 to 30 parts of a white crystal of a zirconium compound including 5-methoxysalicylate. The zirconium compound had a main peak at a Bragg (2θ) angle of 5.5±0.3° when irradiated by a specific X-ray of CuKα and diffracted intensity thereof was as per Table 4 in a scanning speed of from 0.5 to 4°/min.

<Toner formulation>

The following components were kneaded by a biaxial extruder, and pulverized and classified to prepare a mixture having a desired weight-average particle mentioned in Table 2.

| | |
|---|---|
| Styrene-n-butylacrylate copolymer | 80 |
| Polyester resin having an acid value of 12 mg KOH/g | 20 |
| Carbon black #44 (from Mitsubishi Chemical Corp.) | 10 |
| Carnauba wax | 4 |
| The above-mentioned zirconium compound including 5-methoxysalicylate | 2 |

Then, a silica powder (R-972 from Clariant (Japan) KK) was mixed in the mixture by a Henschel Mixer to prepare toners.

The toners were mixed with a carrier formed of ferrite particles having an average particle diameter of 50 μm coated with a silicone resin such that the toners have a concentration of 4.0% to prepare developers. The toner properties were measured in the same method of Examples 25 to 27 using the respective developers. The results are shown in Table 4.

TABLE 4

| | Com. Ex. 6 | Com. Ex. 7 | Com. Ex. 8 | Com. Ex. 9 | Com. Ex. 10 |
|---|---|---|---|---|---|
| Peak A intensity | 1,900 | 16,000 | 1,800 | 15,500 | 1,400 |
| Intensity Ratio (A/B) | 20 | 5 | 12 | 18 | 20 |
| Volatile matter content in toner (weight %) | 3.8 | 0.5 | 2.2 | 1.0 | 3.5 |
| Polyester resin content (wt. %) | 80 | 80 | 80 | 80 | 80 |
| Polyester resin Acid value (mg KOH/g) | 12 | 12 | 12 | 12 | 12 |
| Charge amount of toner in room temperature and humidity (μc/g) | 28 | 25 | 22 | 26 | 23 |
| Charge amount of toner in high temperature and humidity (μc/g) | 23 | 20 | 18 | 21 | 20 |
| Granularity after 50,000 images | 1.0 | 1.10 | 1.23 | 0.95 | 1.11 |

Similarly to Comparative Examples 1 to 5, any of the toners in Comparative Examples 6 to 10 including the charge controlling agent not having a peak A intensity of from 2,000 to 15,000 at a Bragg (2θ) angle of 5.5±0.3° when irradiated by a specific X-ray had a low charge amount. After 50,000 images were produced, granularity and quality of the image deteriorated.

In addition, the charging roller was contaminated in Comparative Example 5, and particularly an image developed around the contaminated portion had much background development. In addition, both ends of the transfer belt in Comparative Example 10 were contaminated.

This document claims priority and contains subject matter related to Japanese Patent Applications Nos. 2002-211125 and 2002-272809, filed on Jul. 19, 2002 and Sep. 19, 2002 respectively, incorporated herein by reference.

Having now fully described the invention, it will be apparent to one of ordinary skill in the art that many changes and modifications can be made thereto without departing from the spirit and scope of the invention as set forth therein.

What is claimed is:

1. An image forming method comprising:

charging an image bearer with a charger;

irradiating the image bearer with light to form an electrostatic latent image thereon;

developing the electrostatic latent image with a toner to form a toner image on the image bearer;

transferring the toner image onto a transfer sheet with a transferer;

fixing the toner image on the transfer sheet upon application of heat; and cleaning a surface of the image bearer with a cleaner; and wherein the toner comprises:

a binder resin;

a colorant; and a zirconium compound formed of zirconium and at least one compound selected from the group consisting of an aromatic oxycarboxylic acid, a salt of an aromatic oxycarboxylic acid and mixtures thereof; said zirconium compound having a main diffraction peak (A) at a Bragg (2θ) angle of 5.5±0.3° and a diffraction intensity of from 2,000 to 15,000 cps when irradiated with a specific X-ray of CuKα.

2. The image forming method of claim 1, wherein said fixing comprises:

transporting the transfer sheet having the toner image thereon while at least one elastic roller contacts the transfer sheet to fix the toner image thereon upon application of heat.

3. The image forming method of claim 1, wherein the zirconium compound further has a sub-diffraction peak (B) at a Bragg (2θ) angle of 31.6±0.3° when irradiated with the specific X-ray of CuKα, and wherein a diffraction intensity ratio (A/B) of the main diffraction peak (A) to the sub-diffraction peak (B) is from 3 to 25.

4. The image forming method of claim 1, wherein the zirconium compound has an average particle diameter of from 0.2 to 4.0 μm.

5. The image forming method of claim 1, wherein the zirconium compound is subjected to an extraction treatment so as to be dispersed in an ion exchanged water at a concentration of $1.5\times10^{-4}$ g/cm$^3$; and wherein the ion exchanged water has a conductivity of from 5 to 20 S/cm.

6. The image forming method of claim 1, wherein a content of the zirconium compound in the toner is from 0.5 to 5 parts by weight based on a total weight of the binder resin.

7. The image forming method of claim 1, wherein the toner comprises a volatile component in an amount not greater than 0.1% by weight based on a total weight of the toner when measured at a temperature of from 100 to 150° C.

8. The image forming method of claim 1, wherein said aromatic oxycarboxylic acid is 3,5-di-tertiary-butylsalicylic acid.

9. The image forming method of claim 1, wherein the binder resin comprises a polyester resin in an amount of from 50 to 100% by weight based on total weight of the binder resin, and wherein the polyester resin has an acid value of from 5 to 25 mg KOH/g.

10. The image forming method of claim 1, wherein the charging is performed while contacting the charger with the image bearer.

11. The image forming method of claim 1, wherein the transferring is performed while contacting the transferer with the image bearer.

12. The image forming method of claim 1, wherein the cleaner is a cleaning blade.

13. A toner composition comprising:

a binder resin;

a colorant; and a zirconium compound formed of zirconium and at least one compound selected from the group consisting of an aromatic oxycarboxylic acid, a salt of an aromatic oxycarboxylic acid, and mixtures thereof;

wherein the zirconium compound has a main diffraction peak (A) at a Bragg (2θ) angle of 5.5±0.3° and a diffraction intensity of from 2,000 to 15,000 cps when irradiated with a specific X-ray of CuKα.

14. The toner composition of claim 13, wherein the zirconium compound further has a sub-diffraction peak (B) at a Bragg (2θ) angle of 31.6±0.3° when irradiated with the specific X-ray of CuKα; and wherein a diffraction intensity ratio (A/B) of the main diffraction peak (A) to the sub-diffraction peak (B) is from 3 to 25.

15. The toner composition of claim 13, wherein the zirconium compound has an average particle diameter of from 0.2 to 4.0 μm.

16. The toner composition of claim 13, wherein the zirconium compound is subjected to an extraction treatment so as to be dispersed in an ion exchanged water at a concentration of $1.5\times10^{-4}$ g/cm$^3$; and wherein the ion exchanged water has a conductivity of from 5 to 20 S/cm.

17. The toner composition of claim 13, wherein a content of the zirconium compound in the toner composition is from 0.5 to 5 parts by weight based on a total weight of the binder resin.

18. The toner composition of claim 13, further comprising a volatile component in an amount not greater than 0.1% by weight based on a total weight of the toner when measured at a temperature of from 100 to 150° C.

19. The toner composition of claim 13, wherein said aromatic oxycarboxylic acid is 3,5-di-tertiary-butylsalicylic acid.

20. The toner composition of claim 13, wherein the binder resin comprises a polyester resin in an amount of from 50 to 100% by weight based on a total weight of the binder resin; and wherein the polyester resin has an acid value of from 5 to 25 mg KOH/g.

* * * * *